US007214425B2

(12) United States Patent
Kolmes et al.

(10) Patent No.: US 7,214,425 B2
(45) Date of Patent: May 8, 2007

(54) HIGH PERFORMANCE FIBER BLEND AND PRODUCTS MADE THEREFROM

(75) Inventors: Nathaniel Kolmes, Hickory, NC (US); Christopher Eric Pritchard, Hickory, NC (US); Mario Mussinelli, Adrara San Martino (IT)

(73) Assignee: Supreme Elastic Corporation, Conover, NC (US)

( * ) Notice: Subject to any disclaimer, the term of this patent is extended or adjusted under 35 U.S.C. 154(b) by 0 days.

(21) Appl. No.: 11/054,388

(22) Filed: Feb. 10, 2005

(65) Prior Publication Data

US 2006/0177656 A1 Aug. 10, 2006

(51) Int. Cl.
*D01F 6/00* (2006.01)

(52) U.S. Cl. ..... 428/357; 428/362; 428/365

(58) Field of Classification Search ..... 428/362, 428/902, 911, 357, 365; 139/383 R, 420 A; 57/200

See application file for complete search history.

(56) References Cited

U.S. PATENT DOCUMENTS

| | | | | | |
|---|---|---|---|---|---|
| 3,831,653 | A | * | 8/1974 | Moore | 152/195 |
| 4,118,921 | A | * | 10/1978 | Adams et al. | 57/200 |
| 4,477,526 | A | * | 10/1984 | Lauterbach | 428/399 |
| 4,552,805 | A | * | 11/1985 | Fish et al. | 428/297.4 |
| 4,612,150 | A | * | 9/1986 | De Howitt | 264/103 |
| 4,759,985 | A | * | 7/1988 | Armiger et al. | 428/367 |
| 4,777,789 | A | | 10/1988 | Kolmes et al. | |
| 4,838,017 | A | | 6/1989 | Kolmes et al. | |
| 4,936,085 | A | | 6/1990 | Kolmes et al. | |
| 4,941,884 | A | * | 7/1990 | Green | 8/120 |
| 5,045,388 | A | * | 9/1991 | Bice et al. | 428/299.1 |
| 5,077,126 | A | * | 12/1991 | Green | 428/374 |
| 5,177,948 | A | | 1/1993 | Kolmes et al. | |
| 5,628,172 | A | * | 5/1997 | Kolmes et al. | 57/210 |
| 5,632,137 | A | | 5/1997 | Kolmes et al. | |
| 5,644,907 | A | | 7/1997 | Kolmes et al. | |
| 5,655,358 | A | | 8/1997 | Kolmes | |
| 5,845,476 | A | | 12/1998 | Kolmes | |
| 5,976,996 | A | * | 11/1999 | Howland | 442/189 |
| 6,057,032 | A | * | 5/2000 | Green | 428/359 |
| 6,341,483 | B1 | | 1/2002 | Kolmes et al. | |
| 6,349,531 | B1 | | 2/2002 | Kolmes et al. | |
| 6,363,703 | B1 | | 4/2002 | Kolmes | |
| 6,381,940 | B1 | | 5/2002 | Kolmes et al. | |
| 6,467,251 | B1 | | 10/2002 | Kolmes | |
| 6,534,426 | B1 | * | 3/2003 | Chiou | 442/203 |
| RE38,136 | E | | 6/2003 | Kolmes | |
| 6,666,235 | B2 | * | 12/2003 | Chi et al. | 139/420 A |
| 6,693,052 | B2 | * | 2/2004 | Howland | 442/189 |
| 6,701,703 | B2 | * | 3/2004 | Patrick | 57/229 |

FOREIGN PATENT DOCUMENTS

| | | |
|---|---|---|
| FR | 2 595 724 | 9/1987 |
| FR | 2 615 533 | 11/1988 |
| FR | 2 659 091 | 9/1991 |

OTHER PUBLICATIONS

Fil a Haute Resistance a la Coupure et a L'abrasion, Public conference May 1997.

Les Files de Fibres Hautes Performances en Filature Fibres Longues, Public conference Mar. 1988.

* cited by examiner

*Primary Examiner*—N. Edwards
(74) *Attorney, Agent, or Firm*—Oblon, Spivak, McClelland, Maier & Neustadt, P.C.

(57) ABSTRACT

A blended yarn is provided having at least one component fiber type being made of stretch broken fibers, preferably of a stretch broken high performance fiber, along with multi-end yarns containing the blended yarn, composite yarns having at least one component being the blended yarn, and articles made from the blended, multi-end or composite yarn.

27 Claims, No Drawings

HIGH PERFORMANCE FIBER BLEND AND PRODUCTS MADE THEREFROM

BACKGROUND OF THE INVENTION

1. Field of Invention

The present invention relates to new fiber blends combining at least one high performance fiber with one or more other fibers in an intimate blend, providing combinations of properties previously unachievable.

2. Discussion of the Background

There are many methods currently present for making fiber blends. However, due to difficulties in processing high performance fibers (such as aramid, glass, or extended chain polyethylene) alongside conventional thermoplastic fibers (such as polyester, nylon, etc), various approaches have been developed to arrive at yarns containing both the high performance fibers and non-high performance fibers. These include such methods as the preparation of composite yarns having a core, around which are wrapped one or more layers/sheaths of yarn. Examples of such composite yarns are provided, for example in U.S. Pat. Nos. 4,777,789; 5,177,948; 5,628,172; 5,845,476; 6,351,932; 6,363,703 and 6,367,290.

Alternative processes used to manufacture these types of composite materials include weaving reinforcing fibers (carbon, aramide, or glass) in multifilament form alternately with multifilaments of thermoplastic matrix fibers. This manufacturing technique has numerous drawbacks, including: poor wettability, a large open-space ratio, and delamination of the reinforcing fibers.

Another technique consists of commingling the multifilaments of reinforcing fibers with the multifilaments of thermoplastic fibers. However, this technique is limited in the ability to use shorter staple length reinforcing fibers, without the need for cutting operations in the preparation of the cut reinforcing fibers. Because of this drawback, it is difficult to obtain the desired feel of the final product combined with the desired strength characteristics given by high performance fibers.

These techniques all have substantial drawbacks in several areas, not the least of which is the cost of making the yarn and difficulties in weaving or braiding.

U.S. Pat. No. 5,910,361 teaches an intimate mixture of reinforcing fibers and thermoplastic matrix fibers formed by a cracking process, wherein the fibers are arranged such that the filaments are all parallel, and must be held together by wrapping a filament of thermoplastic fiber around the assembled mixture of parallel fibers. While this produces a high modulus product, the difficulty involved in ensuring the parallel arrangement of the mixed fibers creates, among other things, added production costs.

SUMMARY OF THE INVENTION

Accordingly, one object of the present invention is to provide a blended yarn having at least one component that is a stretch broken fiber.

Another object of the present invention is to provide a blended yarn that can be used in the production of woven, knit and non-woven materials, while containing a substantial amount of high-performance fibers for strength.

Another object of the present invention is to provide a blended yarn wherein at least one component is a stretch broken high performance fiber, such that the blended yarn has high strength while maintaining excellent hand, processability and launderability.

A further object of the present invention is to provide a composite yarn wherein at least one component of the composite yarn is a blended yarn.

Another object of the present invention is to provide an article formed from the blended yarn, or from the composite yarn having the blended yarn as a component.

These and further objects of the invention, either individually or collectively, have been satistfied by the discovery of a blended yarn, comprising an intimate blend of at least two different fibers, wherein at least one of the at least two different fibers is a stretch broken fiber having a length of from 60 to 200 mm, preferably a stretch broken high performance fiber;

a composite yarn having the blended yarn as at least one component, and articles made from the blended yarn or composite yarn.

DETAILED DESCRIPTION OF THE INVENTION

The term "fiber" as used herein refers to a fundamental component used in the assembly of yarns and fabrics. Generally, a fiber is a component which has a length dimension which is much greater than its diameter or width. This term includes ribbon, strip, staple, and other forms of chopped, cut or discontinuous fiber and the like having a regular or irregular cross section. "Fiber" also includes a plurality of any one of the above or a combination of the above.

As used herein, the term "high performance fiber" means that class of synthetic or natural non-glass fibers having high values of tenacity greater than 10 g/denier, such that they lend themselves for applications where high abrasion and/or cut resistance is important. Typically, high performance fibers have a very high degree of molecular orientation and crystallinity in the final fiber structure.

The term "filament" as used herein refers to a fiber of indefinite or extreme length such as found naturally in silk. This term also refers to manufactured fibers produced by, among other things, extrusion processes. Individual filaments making up a fiber may have any one of a variety of cross sections to include round, serrated or crenular, bean-shaped or others.

The term "intimate blend" as used herein refers to a mixture of fibers of at least two types, wherein the mixture is formed in such a way that the individual filaments of each type of fiber are substantially completely intermixed with individual filaments of the other types to provide a substantially homogeneous mixture of fibers, having sufficient entanglement to maintain its integrity in further processing and use.

The term "stretch broken" as used herein refers to a process in which fibers are hot stretched and broken to produce short fiber lengths, rather than cutting, in order to prevent some of the damage done by the cutting process.

The term "yarn" as used herein refers to a continuous strand of textile fibers, filaments or material in a form suitable for knitting, weaving, or otherwise intertwining to form a textile fabric. Yarn can occur in a variety of forms to include a spun yarn consisting of staple fibers usually bound together by twist; a multi filament yarn consisting of many continuous filaments or strands; or a mono filament yarn which consists of a single strand. A "blended yarn" as used herein refers to a yarn that comprises an intimate blend of at least two different types of fibers.

The term "end" as used herein refers to a single yarn ply used in preparation of multi-end yarns. The two or more ends may be put together by twisting together, wrapping a cover wrap around the combined ends or by air-interlacing as described below.

The term "composite yarn" refers to a yarn prepared from two or more yarns, which can be the same or different. Composite yarn can occur in a variety of forms wherein the two or more yarns are in differing orientations relative to one another. The two or more yarns can, for example, be parallel, wrapped one around the other(s), twisted together, or combinations of any or all of these, as well as other orientations, depending on the properties of the composite yarn desired. Examples of such composite yarns are provided in U.S. Pat. Nos. 4,777,789; 5,177,948; 5,628,172; 5,845,476; 6,351,932; 6,363,703 and 6,367,290, the contents of which are hereby incorporated by reference.

The term "air interlacing" as used herein refers to subjecting multiple strands of yarn to an air jet to combine the strands and thus form a single, intermittently commingled strand. This treatment is sometimes referred to as "air tacking." This term is not used to refer to the process of "intermingling" or "entangling" which is understood in the art to refer to a method of air compacting a multifilament yarn to facilitate its further processing, particularly in weaving processes. A yarn strand that has been intermingled typically is not combined with another yarn. Rather, the individual multifilament strands are entangled with each other within the confines of the single strand. This air compacting is used as a substitute for yarn sizing and as a means to provide improved pick resistance. This term also does not refer to well known air texturizing performed to increase the bulk of single yarn or multiple yarn strands. Methods of air interlacing in composite yarns and suitable apparatus therefore are described in U.S. Pat. Nos. 6,349,531; 6,341,483; and 6,212,914, the relevant portions of which are hereby incorporated by reference.

The present invention relates to a blended yarn comprising an intimate blend of at least two different types of fiber, wherein at least one of the at least two different types of fiber is a stretch broken fiber. Each fiber type has advantages and disadvantages associated with it. For example, aramid fibers (such as KEVLAR, sold by DuPont; TWARON sold by Akzo Nobel; or TECHNORA sold by Teijin) are high strength fibers with high heat resistance. However, garments formed from aramid based yarns do not undergo laundering well, as they tend to fray, typically lasting only about three washings. Extended chain polyolefins (such as SPECTRA, an extended chain polyethylene sold by Allied; or DYNEEMA) can be laundered well and have high strength properties, but do not withstand heating well. Thermoplastic polymer based fibers, such as nylons and polyesters, have high wash durability, but typically do not have the strength characteristics found in the high performance fibers. However, the present inventors have found that by blending various fibers, particularly including one or more high performance fibers, one obtains a final intimate blend spun yarn that maximizes the advantages of the individual fiber components, while suppressing or minimizing the disadvantages.

In the present invention blended yarn, each component fiber type can be used at any desired level, preferably from 10 to 90% by weight of the blended yarn, more preferably from 25–80%. Most preferably, at least one of the high performance fiber components is present in an amount of at least 40% by weight of the blended yarn, in order to take advantage of the high performance characteristics of the fiber, particularly the strength and, in many cases, the cut proof nature of yarn made from the high performance fiber. In a more preferred embodiment, the blended yarn of the present invention comprises 20–60% by weight of aramid fiber, 20–60% by weight of extended chain polyethylene fiber and 20–60% by weight of polyester, wherein the sum of the percentages of each component equals 100%. In a most preferred embodiment, the blended yarn comprises 40% by weight of aramid fiber, 40% by weight of extended chain polyethylene and 20% by weight of polyester. Because of the ability to include high levels of high performance fibers, the resulting blends, while having excellent hand and processability, exhibit very high strength and modulus.

The blended yarn of the present invention can be prepared using any conventional fiber blending technique. Suitable methods include, but are not limited to, blending of tops of different fiber types, with at least one of the fiber types preferably being a stretch broken fiber, most preferably where the stretch broken fiber is a stretch broken high performance fiber. In a more preferred embodiment, at least two of the different fiber types are each stretch broken fibers, most preferably with all of the fibers being stretch broken. The starting fiber for blending is preferably of a length sufficient to provide a level of fiber-to-fiber grab upon blending that is sufficient to enable the blend to maintain its integrity (through intermingling/twisting/entangling processes occurring in the blend). Suitable lengths are those typically associated with staple fibers, more preferably on the order of 3 inches or less in length for each individual fiber. The fiber components can be put into the proper length by any conventional process, including but not limited to, cutting filament or tow, stretch breaking filament or tow. Although not necessary, if desired the filaments can be aligned to be substantially parallel within the blend, although this adds additional processing steps and cost. Substantially parallel, within the context of the present invention, indicates that the predominant portion of the fibers are parallel, while having at least a portion of the fibers still entwining with the other fibers to maintain structural integrity without the need for a tying filament.

An important aspect of the present invention is that at least one of the fibers must be stretch broken, with the length of the stretch broken fiber being important in order to provide the desired tenacity of the blended yarn and the improved regularity of the blend. In the present invention, the length of the fibers produced by stretch breaking is preferably from 60 to 250 mm, more preferably from 60 to 180 mm, most preferably with a fibrous chart of 140 mm. The stretch broken component can be of any fiber type used in the blend. Further, in a particular blend, any or all of the components can be stretch broken fibers. Preferably the stretch broken component of the present blend is a high performance fiber, such as aramid, extended chain polyolefin or metal. In a blend containing more than one type of high performance fiber, it is most preferred that each of the high performance fiber types be stretch broken to the above lengths. This gives the blend the best combination of strength, consistency and regularity for the blended yarn.

Once the desired length is obtained for each component, the fiber components are blended to form the blended fiber as a single end. The single end can then be used as is, or can be combined with one or more additional ends (which may be the same as or different from the blend formed and/or the same as or different from one another) to provide a multi end yarn. Preferably when a plurality of ends are present, the ends are twisted one around the other to provide the multi-end yarn. Alternatively, the single end (or the multi-end yarn) can be used as one component in a composite yarn. The blended yarn of the present invention, either in single or multi end form, can be used as a core component or as a wrap component (or both) in the construction of a composite yarn.

The present invention permits the formation of blended yarns, which when knitted or woven into articles or garments, can provide unique combinations of strength, cut-resistance, washability, hand, heat resistance, UV resistance, conductivity, etc. By changing the composition of the blend itself, it is possible to fine tune or specially tune the properties to give the desired results.

The fibers used to prepare the present blended yarn can be any type of natural or synthetic fiber. Suitable fiber types include, but are not limited to, high performance fibers, such as aramids (for example, KEVLAR, TWARON, or TECHNORA), extended chain polyolefins (for example SPECTRA and DYNEEMA), ceramic fibers, carbon fibers, mineral based fibers, such as fiberglass; metal fibers, such as steel, copper, stainless steel, titanium; thermoplastic fibers, such as nylons, polyesters, viscose, acrylics, and polyethylenes; natural fibers, such as cotton and wool. The blended yarn of the present invention can include any two or more of these fiber types, preferably including one or more high performance fibers to provide the blended yarn with the high performance properties associated with the fibers. Most preferred combinations include blends of an aramid, an extended chain polyolefin and a thermoplastic fiber, such as nylon or polyester. The fibers used in the present invention blended yarn preferably each have a yarn count of from 0.9 to 50 dtex, more preferably from 1.7 to 5 dtex. The final blended yarn preferably has an overall denier of from 90 to 9000, more preferably from 180 to 750. However, the overall denier of the blend can vary outside this range as desired or needed, by controlling the feed rate and output of the blending process.

One improvement provided by the present invention is the ability to blend any types of fibers, as well as any number of types of fibers, into a single blended yarn.

At least one of the fiber types used in the blended yarn must be a stretch broken fiber, having a stretch broken length. The remaining fiber types making up the blend can be stretch broken or cut to form the necessary length for blending, or can be natural fibers of the appropriate length for blending (or cut to such length as desired), such as cotton or wool fibers. In a more preferred embodiment, the present invention blended yarn comprises a blend of all stretch broken fibers. In a most preferred embodiment, the blended yarn comprises an intimate blend of stretch broken aramid and extended chain polyethylene fibers along with at least one thermoplastic non-high performance fiber, such as polyester or nylon.

In preparing a preferred embodiment of the blended yarns of the present invention, it is preferred that the high performance fibers be stretch broken to the above noted lengths. The stretch breaking process creates the desired length fiber and aligns the individual fibers, permitting blending without the need to undergo carding of the high performance fibers. Additionally, the stretch breaking process results in long fibers obtained by breaking continuous filaments and eliminating their weak points to obtain a strong long staple yarn. The stretch broken fibers are then blended with the tops of the other fibers to produce the blend. The non-stretch broken fibers may be carded prior to blending, if desired or needed.

Some exemplary embodiments include:

(in these preferred embodiments, the aramid, chain extended polyethylene, stainless steel wire and fiberglass components are all preferably stretch broken to a length of from 60 to 200 mm)

Blended Yarn Embodiment 1:

| | |
|---|---|
| Aramid | 40% |
| Chain extended polyethylene | 40% |
| Polyester (PET) | 20% |

Blended Yarn Embodiment 2:

| | |
|---|---|
| Aramid | 40% |
| Chain extended polyethylene | 40% |
| Nylon-6,6 | 20% |

Blended Yarn Embodiment 3:

| | |
|---|---|
| Aramid | 40% |
| Stainless Steel wire | 40% |
| Polyester (PET) | 20% |

Blended Yarn Embodiment 4:

| | |
|---|---|
| Fiberglass | 40% |
| Aramid | 40% |
| Cotton | 20% |

Composite Yarn Embodiment 1:

Core: Blended Yarn Embodiment 1 above $1^{st}$ Wrap: 200 denier polyester wrapped in either Z or E direction $2^{nd}$ Wrap: 200 denier polyester wrapped in opposite direction from $1^{st}$ Wrap Composite Yarn Embodiment 2:

Core: Blended Yarn Embodiment 3 above $1^{st}$ Wrap: 250 denier SPECTRA (extended chain polyethylene) wrapped in either Z or E direction $2^{nd}$ Wrap: 200 denier nylon-6,6 wrapped in opposite direction from $1^{st}$ Wrap $3^{rd}$ Wrap: 200 denier nylon-6,6 wrapped in opposite direction from $2^{nd}$ Wrap Note: in the case of a composite yarn, the wrap layers are wrapped at a number of turns necessary to provide coverage of the underlying components and sufficient to maintain the balance and integrity of the yarn, as disclosed in the US patents noted above in the definition of the term "composite yarn".

Accordingly, the present invention blended yarn can be used by itself in a single end product, or can become a part of a yarn product containing other fibers and fiber types. Preferably, the present invention blended yarn can be used in single end or multi-end yarns, or as one or more components of a component yarn. The single end, multi-end or component yarn containing the blended yarn of the present invention can be used to prepare any desired article, using any conventional process including, but not limited to, knitting and weaving, as well as non-woven production processes. Preferred articles to be prepared using the present invention blended yarn (whether in single end, multi-end or component yarn) include, but are not limited to, gloves, socks, bodysuits, pants, shirts and headwear.

EXAMPLES

Continuous filaments of raw material are supplied in tow. If the tow is not available on the market, the tow can be prepared using conventional textile processes. The tow, during the stretch breaking process, is elongated mechanically until its breaking point. With a specific method, relative to each raw material and readily determined by those of ordinary skill, the tow is subjected to different tensile strengths until discontinuous fibers with variable lengths are obtained. The fibrous chart/diagram obtained is related to the technical characteristics of the raw material and to the draw report to which it has been subjected. The result of the stretch breaking process is a sliver of constant weight. During the blending process, a variable quantity of slivers related to the required percentages are used. With conventional textile blending machinery, the slivers are mixed together until substantially uniform amalgamated tops (intimate blend) are obtained. The composition of the tops is exactly the same as the blend percentage. The length of the fibers contained in the tops correspond to the average/mean of the fibrous diagram obtained from the fibers used at the beginning. From this point, the blend can be carried forward with conventional spinning processes.

The invention claimed is:

1. A blended yarn, comprising:

an intimate blend of at least three different fiber types, said three different fiber types being aramid, chain extended polyolefin and polyester, wherein at least one of said fiber types is a stretch broken fiber, wherein said stretch broken fiber comprises fibers having a length of from 60 mm to 200 mm, and wherein said blended yarn has a yarn count of from 1 to 50 dtex.

2. The blended yarn of claim 1, wherein said stretch broken fiber is aramid or chain extended polyolefin.

3. The blended yarn of claim 1, wherein said intimate blend further comprises at least one additional fiber type different from said at least three different fiber types.

4. The blended yarn of claim 1, wherein said intimate blend comprises (a) 20–60% aramid fibers, (b) 20–60% chain extended polyolefin fibers and (c) 20–60% polyester fibers, wherein the total of (a), (b) and (c) is 100%.

5. The blended yarn of claim 1, wherein each of said fiber types is a stretch broken fiber.

6. The blended yarn of claim 2, wherein only said high performance fiber is a stretch broken fiber.

7. The blended yarn of claim 1, having a yarn denier of from 90 to 9000.

8. A composite yarn, comprising:

a core, and at least one cover strand wrapped around said core;

wherein either or both of said core and said at least one cover strand is a blended yarn according to claim 1.

9. A multi end yarn, comprising:

two or more ends, wherein at least one of said two or more ends is a blended yarn in accordance with claim 1.

10. A multi end yarn, comprising:

two or more ends, wherein each of said two or mote ends is a blended yarn in accordance with claim 1.

11. An article made from the blended yarn of claim 1.

12. The article of claim 11, wherein said blended yarn is knitted to form the article.

13. The article of claim 11, wherein said blended yarn is woven to form the article.

14. The article of claim 11, wherein the article is a non-woven article formed from the blended yarn.

15. The article of claim 11, wherein said article is a member selected from the group consisting of gloves, socks, bodysuits, pants, shirts and headwear.

16. An article made from the composite yam of claim 8.

17. The article of claim 16, wherein said composite yarn is knitted to form the article.

18. The article of claim 16, wherein said composite yarn is woven to form the article.

19. The article of claim 15, wherein said article is a member selected from the group consisting of gloves, socks, bodysuits, pants, shirts and headwear.

20. An article made from the multi-end yarn of claim 9.

21. The article of claim 20, wherein said multi-end yarn is knitted to form the article.

22. The article of claim 20, wherein said multi-end yarn is woven to form the article.

23. The article of claim 20, wherein said article is a member selected from the group consisting of gloves, socks, bodysuits, pants, shirts and headwear.

24. An article made from the multi-end yarn of claim 10.

25. The article of claim 23, wherein said multi-end yarn is knitted to form the article.

26. The article of claim 23, wherein said multi-end yarn is woven to form the article.

27. The article of claim 23, wherein said article is a member selected from the group consisting of gloves, socks, bodysuits, pants, shirts and headwear.

* * * * *